US010934790B2

(12) United States Patent
Eriksen

(10) Patent No.: US 10,934,790 B2
(45) Date of Patent: Mar. 2, 2021

(54) GRIPPING DEVICE FOR HANDLING EQUIPMENT WITH A DRILL STRING

(71) Applicant: Electrical Subsea & Drilling AS, Straume (NO)

(72) Inventor: Egil Eriksen, Ål (NO)

(73) Assignee: Electrical Subsea & Drilling AS, Straume (NO)

( * ) Notice: Subject to any disclaimer, the term of this patent is extended or adjusted under 35 U.S.C. 154(b) by 0 days.

(21) Appl. No.: 16/628,339

(22) PCT Filed: Jul. 4, 2018

(86) PCT No.: PCT/NO2018/050178
§ 371 (c)(1),
(2) Date: Jan. 3, 2020

(87) PCT Pub. No.: WO2019/009736
PCT Pub. Date: Jan. 10, 2019

(65) Prior Publication Data

US 2020/0199948 A1 Jun. 25, 2020

(30) Foreign Application Priority Data

Jul. 6, 2017 (NO) ..... 20171114

(51) Int. Cl.
*E21B 19/10* (2006.01)

(52) U.S. Cl.
CPC ..... *E21B 19/10* (2013.01)

(58) Field of Classification Search
CPC ..... E21B 19/10
See application file for complete search history.

(56) References Cited

U.S. PATENT DOCUMENTS 1,844,378 A * 2/1932 Campbell ..... E21B 19/10 188/67
3,722,603 A * 3/1973 Brown ..... E21B 19/10 173/159
4,576,254 A * 3/1986 Cox ..... E21B 19/07 188/67

(Continued)

OTHER PUBLICATIONS

Norwegian Search Report for NO 20171114, dated Feb. 6, 2018.
International Search Report and the Written Opinion for PCT/NO2018/050178, dated Aug. 29, 2018.

*Primary Examiner* — Matthew R Buck
(74) *Attorney, Agent, or Firm* — Andrus Intellectual Property Law, LLP

(57) ABSTRACT

A gripping device is adapted for handling equipment with a drill string, wherein an annular actuator housing includes a hydraulically activated, rotatable cam disc which is arranged to displace a number of locking slides from a first position, in which the locking slides are retracted into the actuator housing, and a second position, in which the locking slides are in engagement with the drill string extending through a center opening in the gripping device, by abutting against a shoulder of a tool joint in the drill string. The gripping device is connected to a hydraulic supply and return for the actuation of the cam disc via a hydraulic coupler in a connection port on the actuator housing. Alternatively pressurizing and ventilating two adjacent actuation volumes in the cam disc brings about rotation of the cam disc within a sector of the cam disc.

5 Claims, 8 Drawing Sheets

(56) References Cited

U.S. PATENT DOCUMENTS

| | | | | |
|---|---|---|---|---|
| 8,167,050 | B2 | 5/2012 | Webre et al. | |
| 10,036,223 | B2 * | 7/2018 | Fabela | E21B 33/063 |
| 2008/0277108 | A1 | 11/2008 | Bouligny, Jr. et al. | |
| 2018/0087334 | A1 * | 3/2018 | Bouligny | E21B 19/164 |

* cited by examiner

GRIPPING DEVICE FOR HANDLING EQUIPMENT WITH A DRILL STRING

CROSS-REFERENCE TO RELATED APPLICATIONS

This application is the U.S. national stage application of International Application PCT/NO2018/050178, filed Jul. 4, 2018, which international application was published on Jan. 10, 2019, as International Publication WO 2019/009736 in the English language. The International Application claims priority of Norwegian Patent Application No. 20171114, filed Jul. 6, 2017. The international application and Norwegian application are both incorporated herein by reference, in entirety.

FIELD

The invention relates to a gripping device for handling equipment with a drill string by the gripping device, with equipment fixed to it, hanging on the upper, conical portion of one of the tool joints in the drill string. The device may be integrated in a tool or equipment or may be a free-standing component which is combined with other equipment. The device may be used for installing and pulling equipment in the open sea, or in a marine riser. In drilling and other well operations, the drill string will pass through a center opening in the gripping device, the equipment handled and further down into the well.

BACKGROUND

Handling underwater equipment and well equipment by means of a drill string, by the equipment being released or locked mechanically or hydraulically by means of a tool that is joined into, or is fitted to the lower end of, the drill string, is prior art. Time-consuming, tool-related running of the drill string and connection and disconnection of the tool in the drill string may be avoided by the equipment being hung on an ordinary tool joint in the drill string. The equipment can thereby go with the drill string to the surface or be installed in connection with the drill string being pulled or installed for other purposes.

From U.S. Pat. No. 4,576,254A a coupling which can be attached to a wellhead or a well-pipe-handling machine and is suitable for gripping a pipe that is run into or pulled out of the well is known. A housing has a center opening and accommodates several wedges that are placed around the center opening and are radially movable between guides in the housing. The wedges are displaced by a hydraulic cylinder, on the outside of the housing, rotating a ring supported in the housing and associated camming segments abutting against the wedges.

US2008277108A1 discloses an elevator with a horseshoe-shaped body with a slot for receiving a pipe, and an actuator assembly with jaws that can be moved into engagement with the pipe by a rotatable cam ring, supported in the body and connected to an actuator, having an internal cam surface against which the jaws abut.

SUMMARY

The invention has for its object to remedy or reduce at least one of the drawbacks of the prior art or at least provide a useful alternative to the prior art.

The object is achieved, according to the invention, through the features that are specified in the description below and in the claims that follow.

An annular gripping device actuates a number of locking slides which grip loosely around the drill-pipe periphery of a drill string in the center opening of the actuator housing. Underwater equipment can be pulled to the surface or be installed by the gripping device, with other equipment, hanging on the top side of the tool joint of a drill pipe. When the equipment has been rotated into the correct orientation, has been landed and is to be locked in a receiver unit in the open sea or in a riser, the drill string may be lowered through the gripping device until the lower portion of the above-lying tool joint is resting against the top side of the locking slides and is pressing the equipment against and end stop with weight from the drill string. This may, for example, be relevant if it is necessary to compress packers in the equipment. After the equipment has been locked to the receiver unit, or the riser, the locking slides are moved back into the housing. The return of locking slides may happen in several ways, depending on the application.

The invention is defined by the independent claim. The dependent claims define advantageous embodiments of the invention.

The invention relates, more specifically, to a gripping device adapted for handling equipment with a drill string, wherein an annular actuator housing includes a hydraulically activated, rotatable cam disc which is arranged to move a number of locking slides from a first position, in which the locking slides are retracted into the actuator housing, and a second position, in which the locking slides are in engagement with the drill string extending through a center opening in the gripping device, by abutting against a shoulder on a tool joint in the drill string.

When one side of a hydraulic actuation chamber arranged in the cam disc is being pressurized and the other is being ventilated, the cam disc will rotate so that the locking slides are pushed out into the center opening of the gripping device. As the cam disc is rotated in the opposite direction, the locking slides are moved back into the housing. The returning of slides may, for example, happen by means of spring force or an eccentric ring.

When operating in a marine riser, where the density of the medium in the riser is higher than that of the medium at a rear side of the locking slides, which are pressure-compensated against the open sea, it is an advantage to return the locking slides by means of a differential pressure. This presupposes the media being separated by means of dynamic seals. The conical portion (shoulder) and the external diameter of the drill-pipe tool joints will also help to push the slides into the housing when the cam disc has been rotated back. An example of this may be that the compensation system at the rear side of the locking slides is blocked. Then a safety valve in the locking slide will open and equalize the pressure while the locking slide is being pushed back into the housing by the drill string.

Hydraulic-fluid supply and return for the actuation of the cam disc takes place via a hydraulic coupler which is inserted into a connection port externally on the actuator housing and which, through hydraulic connection to two actuation volumes in the cam disc, brings about rotation within a sector of the cam disc. The hydraulic coupler is arranged externally on a receiver unit in the open sea, and externally on a riser, and it is moved with a hydraulic actuator into or out of the gripping device through an opening in the receiver unit or the pipe surrounding the gripping device.

The invention relates, more specifically, to a gripping device adapted for handling equipment with a drill string, wherein an annular actuator housing includes a hydraulically activated, rotatable cam disc which is arranged to displace a number of locking slides from a first position, in which the locking slides are retracted into the actuator housing, and a second position, in which the locking slides are in engagement with the drill string extending through a center opening in the gripping device, by abutting against a shoulder on a tool joint in the drill string, characterized by the gripping device being connected to a hydraulic supply and return for the actuation of the cam disc via a hydraulic coupler in a connection port on the actuator housing, and by alternate pressurization and ventilation of two adjacent actuation volumes in the cam disc bringing about rotation of the cam disc within a sector of the cam disc.

The locking slides may be provided with dynamic seals.

The hydraulic coupler may be arranged externally on a receiver unit in the open sea, or externally on a riser, and may include a hydraulic actuator which is arranged to move the hydraulic coupler into or out of a connection port in the actuator housing through an opening in the receiver unit or the pipe surrounding the gripping device.

A spring-loaded peg may be arranged to engage with a first or a second recess in the cam disc and hold the cam disc in position, when the locking slides have been pushed out into the second position and when the locking slides are in the first position, respectively.

The locking slide may be provided with a check valve which, via a bore, is arranged to let liquid through from a rear side of the locking slide when the locking slide is being returned to the first position.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 1:
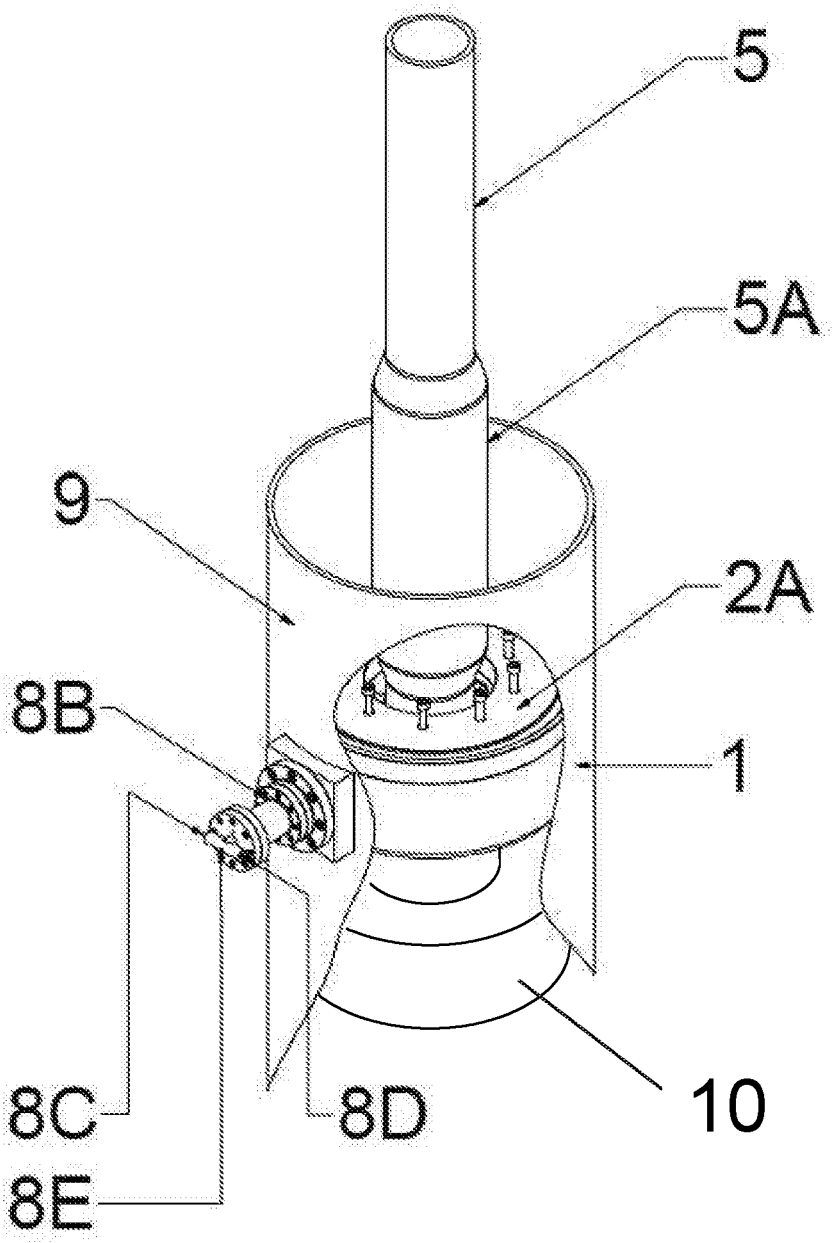
FIG. 1 shows, in perspective, a gripping device with handled equipment fixed to it, in an outer pipe, with a drill string through the center opening of the actuator housing.
Figure 2:
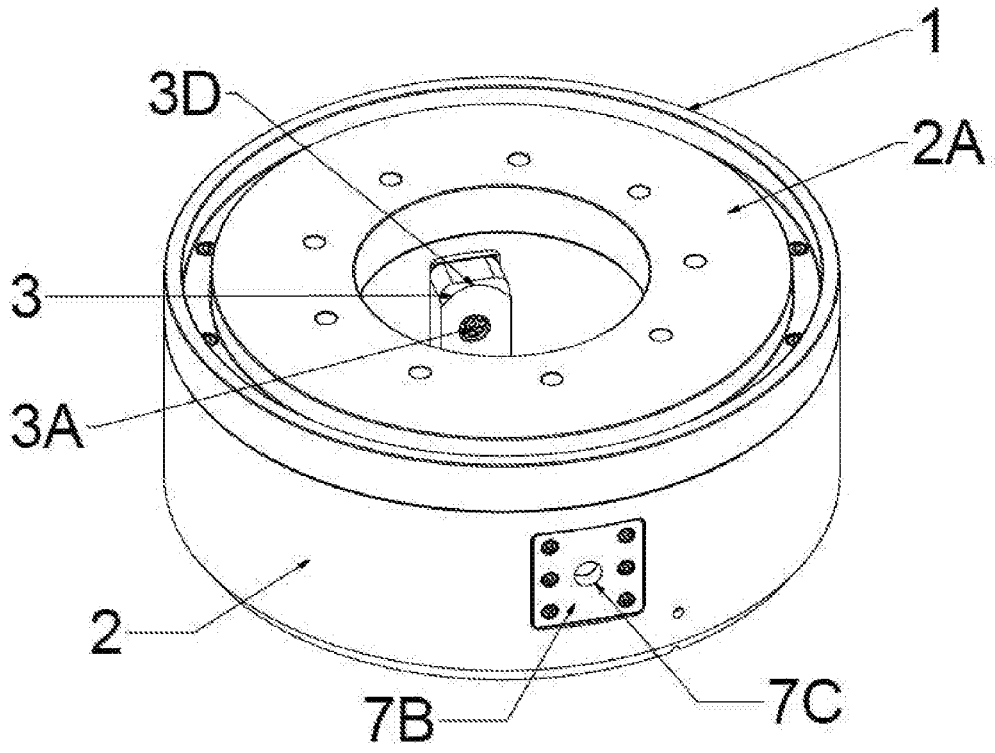
FIG. 2 shows, in perspective, the gripping device externally, with locking slides in the outer position.

Reference is first made to FIG. 1, in which the reference numeral 1 indicates a gripping device fixed to equipment 10 which is arranged to be handled by means of a drill string 5 by connection via the gripping device 1. Here, the gripping device 1 and the equipment 10 are shown to have been lowered into and positioned in a riser 9.

Figure 3A:
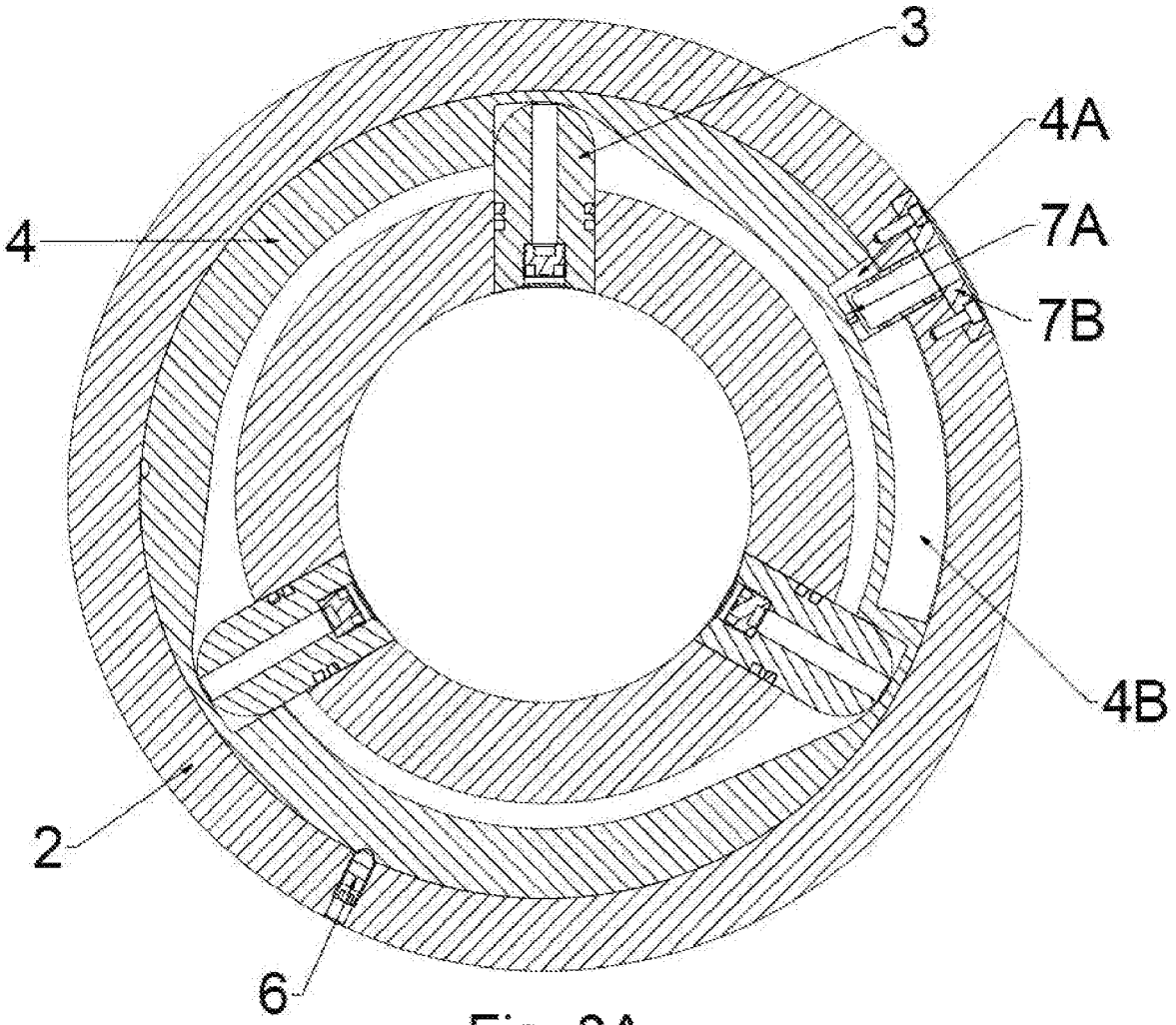
FIG. 3 shows a horizontal section through the gripping device, with locking slides in the inner position in FIG. 3A and in the outer position in FIG. 3B.

Reference is now made to FIGS. 2, 3A, 3B, 4 and 5. An annular actuator housing 2 with a top plate 2A is provided with a number of locking slides 3 surrounding a center opening in the gripping device 1. The locking slides 3 are kept inside the actuator housing 2 when a hydraulically activated, rotatable cam disc 4, which is in movable engagement with the locking slides 3, is in a position rotated back, as shown in FIG. 3A. In the exemplary embodiment, there is a differential pressure between a static pressure in the riser 9 (see FIG. 1) and an external sea-water pressure, causing retraction of the locking slides 3. Alternatively, the locking slides 3 may be pushed back mechanically, for example by spring force (not shown).

Figure 3B:
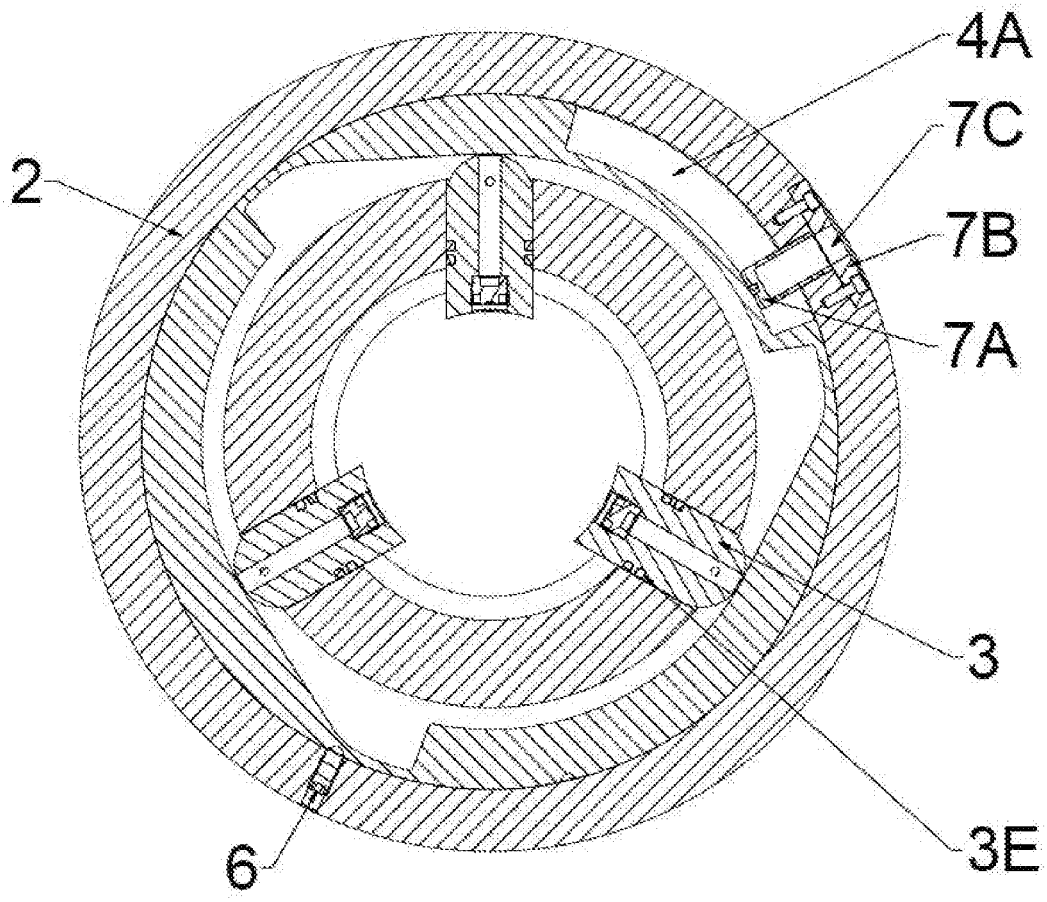
Figure 4:
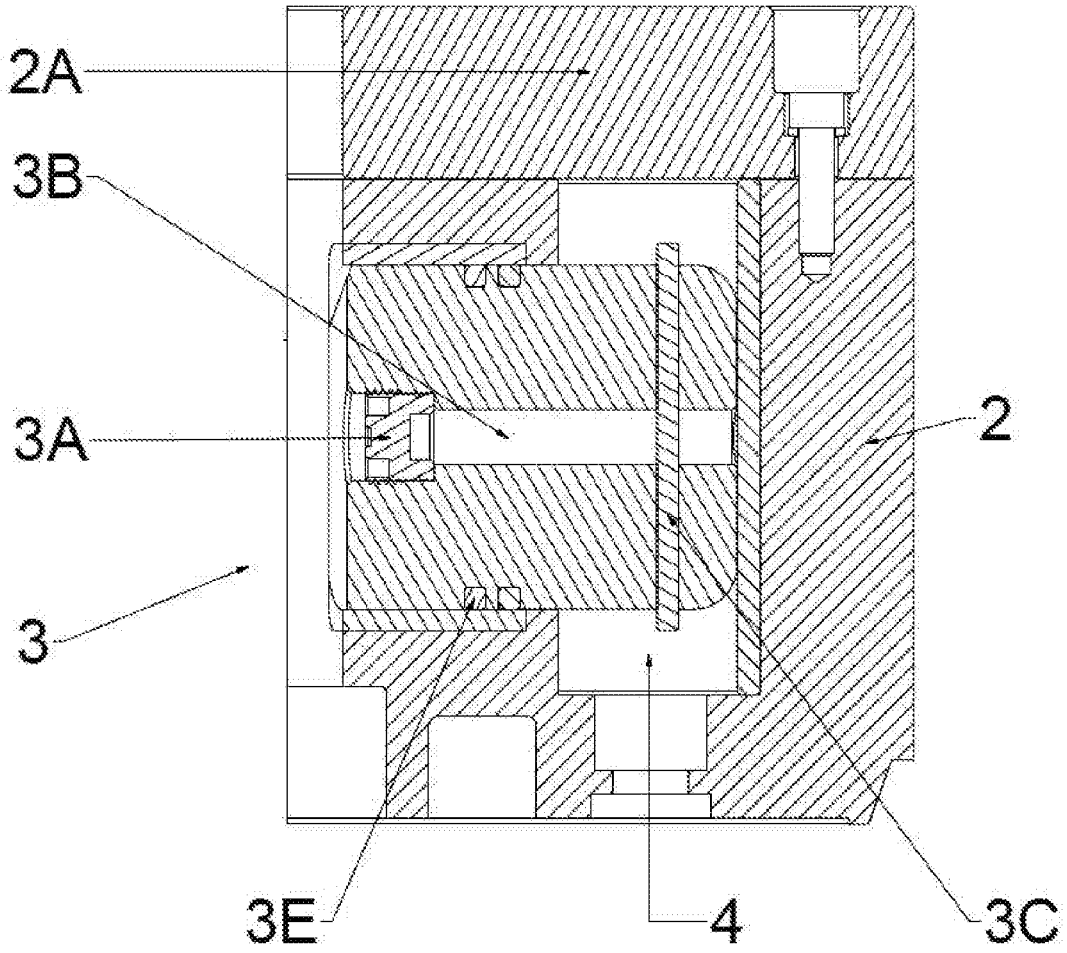
FIG. 4 shows a vertical section through a locking slide in a first, retracted position.
Figure 5:
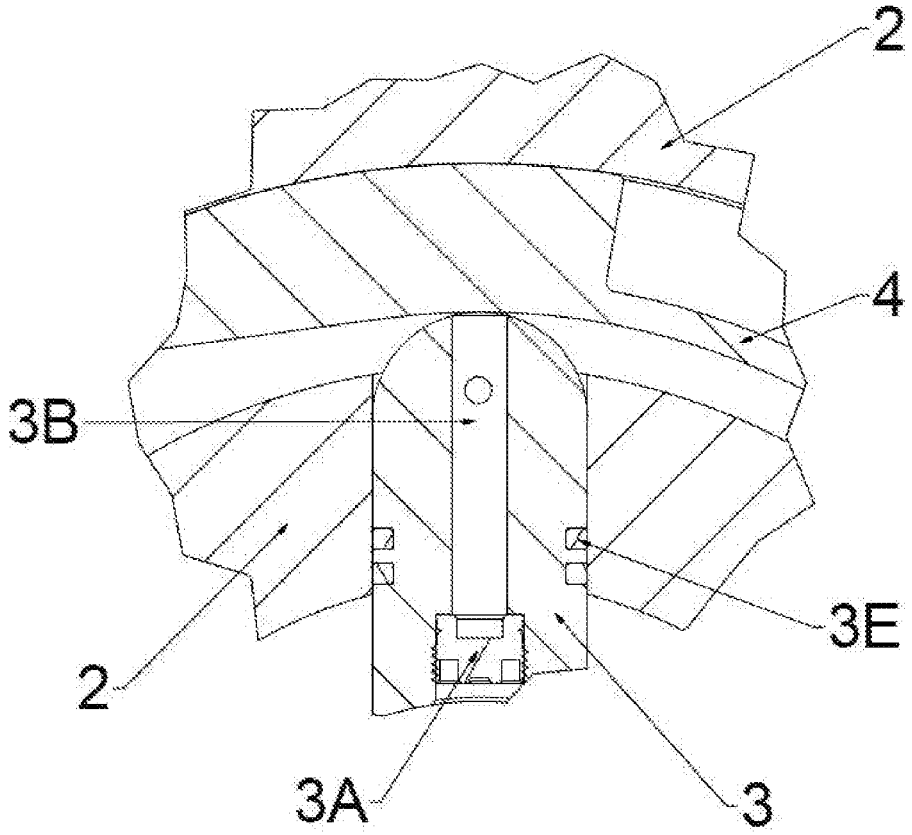
FIG. 5 shows a horizontal section through a locking slide in the outer position.
Figure 6:
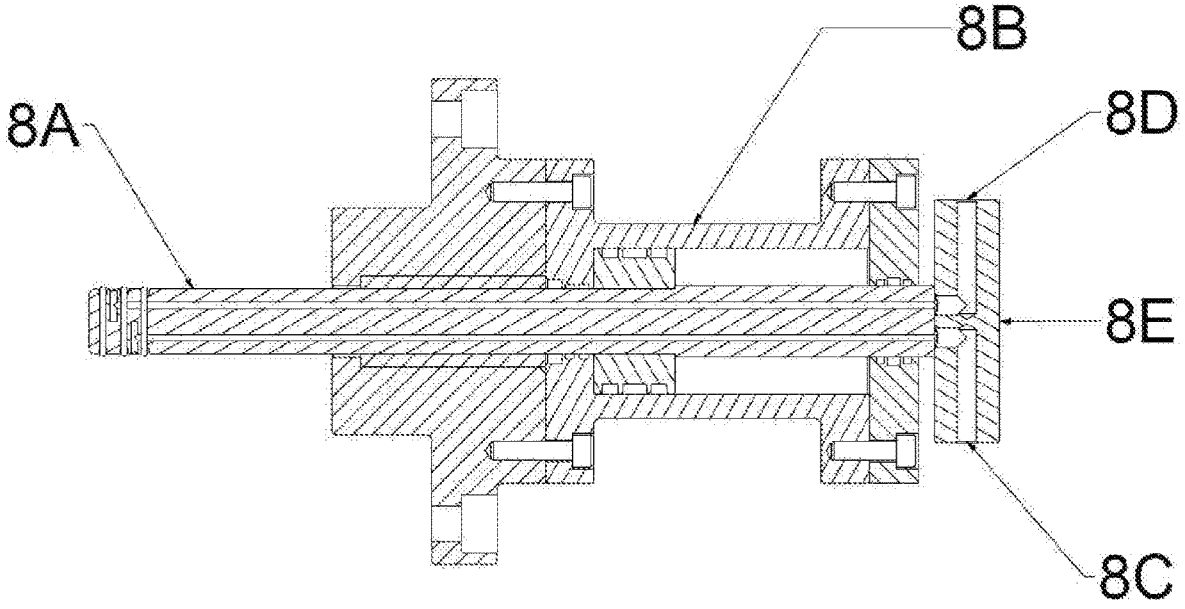
FIG. 6 shows a horizontal section through a hydraulic coupler and a hydraulically operated cylinder which moves the coupler into or out of the actuation port in the housing.
Figure 7:
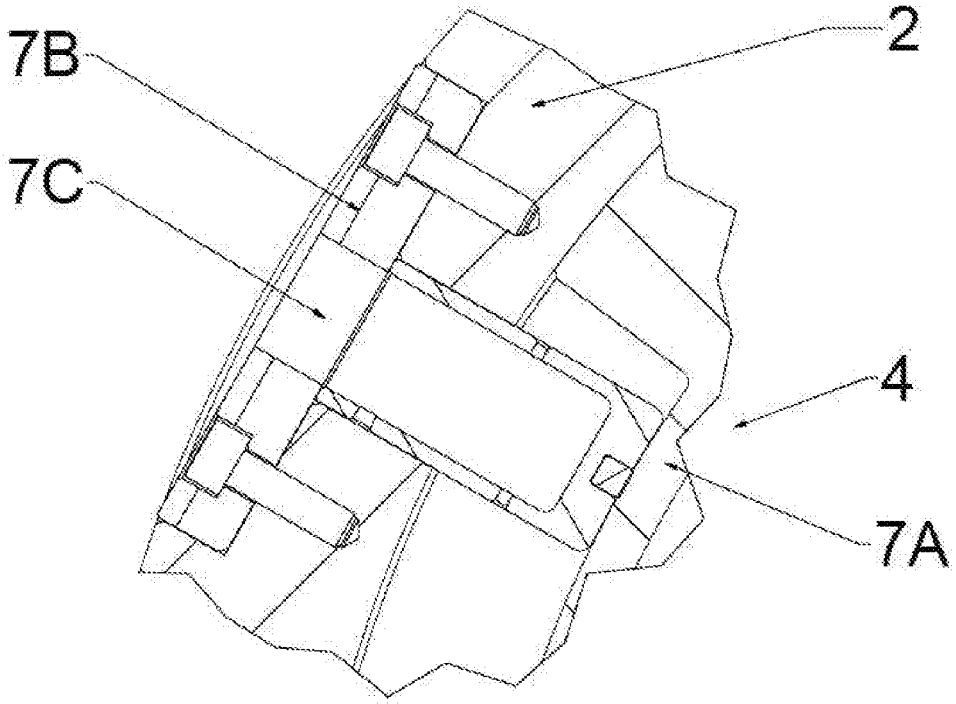
FIG. 7 shows a horizontal section through a plate dividing the actuation chamber into two separate volumes, an external flange for attaching the dividing plate to the actuator housing, a connection port, and inner bores in the dividing plate for pressurizing and ventilating the actuation volumes.

FIGS. 4 and 5 show a cross-cut locking slide 3 which is provided, here, with a check valve 3A which, via a bore 3B, will let liquid through from a rear side of the locking slide 3 to prevent blocking of the locking slide 3 by an enclosed liquid volume at the rear side of the locking slide 3, for example by the use of volume compensation (not shown). As the cam disc 4 is rotated forwards, the outer ends of the locking slides 3 are pushed out into the center opening of the housing 2 and grip loosely around the drill string 5, as shown in FIG. 3B. The locking slides 3 are provided with through pins 3C (see FIG. 4) forming end stops for the locking slides 3 in the outer position. Upper and lower edges of the outer ends of the locking slides 3 are formed with bevels 3D for abutment against upper and lower conical shoulder portions, respectively, of a tool joint 5A of the drill string 5. Dynamic seals 3E around the locking slides 3 form a sealing partition between the medium in the center opening of the actuator housing 2 and the enclosed and possibly volume-compensated medium at the rear side of the locking slides 3.

In the actuator housing 2 of the gripping device 1, a spring-loaded peg 6 is arranged (see FIGS. 3A and 3B), which, with an end portion, enters one of two recesses at the outer edge of the cam disc 4 and holds the cam disc 4 in place, as the locking slides 3 have been moved into the outer position and when the locking slides 3 are in the retracted position, respectively. By means of a spring (not shown) on the peg 6, the end portion is held in place in one of the recesses on the edge of the cam disc 4. The peg 6 is forced back against the spring and out of the recess as the cam disc 4 is rotated away from an end position by hydraulic actuation.

An actuation chamber comprises two actuation volumes 4A, 4B which are separated by a dividing plate 7A in a recess in a sector along an outer edge of the cam disc 4, and the actuation volumes 4A, 4B are pressurized and ventilated, respectively, depending on the desired direction of rotation of the cam disc 4. The dividing plate 7A is provided with an external flange 7B and projects in through an opening in a recess in the outer wall of the actuator housing, to which the flange 7B is screwed. The dividing plate 7A forms a sealing partition between the actuation volumes 4A, 4B in the recess in the cam disc 4, which is surrounded by a seal (not shown) against the inside of the outer wall of the actuator housing 2.

From the outside of the flange 7B, there is a connection port 7C with a bore into the dividing plate 7A. A hydraulic coupler 8A has been inserted into the bore by means of a hydraulically operated cylinder 8B for connecting and disconnecting the coupler 8A. The cylinder 8B will be arranged externally on a receiver unit in the open sea (not shown), or externally on the riser 9. This is shown in a simplified manner in FIG. 1 in the form of a section of the riser 9. In case a riser application is concerned, the passage in the pipe wall will be provided with a seal against the outer environment.

Farthest inwards in the bore from the connection port 7C, lateral outlets to the actuation chambers 4A, 4B have been placed, for alternately pressurizing and ventilating the liquid volumes, depending on the direction of rotation of the cam disc 4. There is hydraulic communication between external hydraulic hoses 8C, 8D and the actuation volumes 4A, 4B via bores in an external handle 8E on the coupler 8A and longitudinal bores through the coupler 8A, discharging into lateral outlets which are arranged to correspond with the lateral outlets of the dividing plate 7A to the actuation volumes 4A, 4B. The hydraulic connections between the lateral outlets in the dividing plate 7A and the coupler 8A, respectively, to the actuation chambers 4A, 4B are separated by means of annular seals externally on the coupler 8A.

In the case of emergency, there is a possibility of manual connection or disconnection of the coupler 8A by means of the external handle 8E, which is adapted for operation by an underwater vehicle (ROV). For the coupler 8A to be moved manually, the hydraulic lines of the cylinder 8B must be ventilated, typically by being severed.

It should be noted that all the above-mentioned embodiments illustrate the invention, but do not limit it, and persons skilled in the art may construct many alternative embodiments without departing from the scope of the attached claims. In the claims, reference numbers in brackets are not to be regarded as restrictive. The use of the verb "to comprise" and its different forms does not exclude the presence of elements or steps that are not mentioned in the claims. The indefinite article "a" or "an" before an element does not exclude the presence of several such elements.

The fact that some features are indicated in mutually different dependent claims does not indicate that a combination of these features cannot be used with advantage.

The invention claimed is:

1. A gripping device adapted for handling equipment with a drill string, the gripping device comprising an annular actuator housing having a hydraulically activated, rotatable cam disc which is arranged to displace a number of locking slides from a first position, in which the locking slides are retracted in-to the actuator housing, and a second position, in which the locking slides are in engagement with the drill string extending through a center opening in the gripping device, by abutting against a shoulder of a tool joint in the drill string, wherein the gripping device is connected to a hydraulic supply and return for the actuation of the cam disc via a hydraulic coupler in a connection port on the actuator housing, and wherein alternately pressurizing and ventilating two adjacent actuation volumes in the cam disc with a hydraulic fluid in communication with the hydraulic supply and return brings about rotation of the cam disc within a sector of the cam disc which displaces the locking slides between the first position and the second position.

2. The gripping device according to claim 1, wherein the locking slides are provided with dynamic seals.

3. The gripping device according to claim 1, wherein the hydraulic coupler is arranged externally on a receiver unit in the open sea, or externally on a riser, and includes a hydraulic actuator which is arranged to move the hydraulic coupler into or out of the connection port in the actuator housing through an opening in the receiver unit or the riser surrounding the gripping device.

4. The gripping device according to claim 1, wherein a spring-loaded peg is arranged to engage with a first recess or a second recess in the cam disc and hold the cam disc in position, when the locking slides have been pushed out into the second position and when the locking slides are in the first position, respectively.

5. The gripping device according to claim 1, wherein the locking slides are provided with check valves which, via bores, are arranged to let liquid through from a rear side of the locking slides when the locking slides are being returned to the first position.

* * * * *